US007990082B2

(12) United States Patent
Dilley et al.

(10) Patent No.: US 7,990,082 B2
(45) Date of Patent: Aug. 2, 2011

(54) METHODS AND SYSTEMS FOR OPERATING AND CONTROLLING THEATRICAL LIGHTING

(76) Inventors: Robert Dilley, Los Angeles, CA (US); David Noriega, Los Angeles, CA (US); Jim Mullens, Los Angeles, CA (US)

( * ) Notice: Subject to any disclaimer, the term of this patent is extended or adjusted under 35 U.S.C. 154(b) by 469 days.

(21) Appl. No.: 12/287,650

(22) Filed: Oct. 10, 2008

(65) Prior Publication Data

US 2009/0128061 A1 May 21, 2009

Related U.S. Application Data

(60) Provisional application No. 60/999,270, filed on Oct. 16, 2007.

(51) Int. Cl.
*H05B 37/00* (2006.01)
*H05B 39/00* (2006.01)

(52) U.S. Cl. ..... 315/317; 315/312; 315/185 R

(58) Field of Classification Search ..... 315/317–319, 315/312, 185 R, 192, 291, 294
See application file for complete search history.

(56) References Cited

U.S. PATENT DOCUMENTS 5,668,537 A * 9/1997 Chansky et al. ..... 340/3.7
2002/0105290 A1* 8/2002 Chansky et al. ..... 315/294
* cited by examiner

*Primary Examiner* — Daniel D Chang
(74) *Attorney, Agent, or Firm* — Christie, Parker & Hale, LLP

(57) ABSTRACT

A system and method for increasing a number of lights operated and/or controlled by dimmer boxes of theatrical light systems. In one embodiment, a master box is coupled to a chain of slave boxes in series. The master box receives a control signal and generates a switching signal for controlling the master box and the slave boxes. The switching signal is transmitted from the master box to the slave boxes through the series connections. Each of the master box and the slave boxes include a light signal input and a plurality of light signal outputs, and select among the plurality of light signal outputs according to the switching signal.

12 Claims, 7 Drawing Sheets

METHODS AND SYSTEMS FOR OPERATING AND CONTROLLING THEATRICAL LIGHTING

CROSS-REFERENCE TO RELATED APPLICATION(S)

This application claims priority to and the benefit of Provisional Patent Application No. 60/999,270, filed in the United States Patent and Trademark Office on Oct. 16, 2007, the entire content of which is incorporated herein by reference.

FIELD OF THE INVENTION

The invention relates generally to the operation and control of theatrical light systems for lighting design and performance, and, more particularly, to methods and systems for increasing a number of lights operated and/or controlled by dimmer boxes of theatrical light systems.

BACKGROUND OF THE INVENTION

Theatrical lighting for live performances and movie and television production continues to increase in complexity. A typical theater employs hundreds of separate lights and lighting systems such as house lights, stage lights, scenery lighting, spotlights and various special effects. Typically, individual lights or groups of lights are controlled through dimmer circuits, which are located at remote locations from the lights for environmental considerations such as noise and temperature control.

Individual dimmer circuits are mounted in dimmer boxes, which contain power and signal distribution to the individual dimmer circuits. Control of dimmer boxes has been provided through lighting control consoles, which allow adjustment of individual dimmer circuits. Industry standards for communication between control consoles and dimmer boxes have been established by the United States Institute for Theater Technology, Inc. ("USITT"). For example, digital data transmission between control consoles and dimmer circuits has been established by the USITT in a standard identified as DMX or DMX512.

In various embodiments of dimmer boxes, structures have been provided that accept a number of dimmer circuits ranging from 6 to in excess of 200 and one or more plug-in control circuits. One significant drawback of the embodiments of dimmer boxes is that the dimmer boxes are large and heavy. This adds significantly to the cost of operating theatrical lighting. This drawback is demonstrated in theatrical and television settings where lighting crews associated with a musical or theatrical production repeatedly are required to set up lighting connectors at multiple locations, often on sequential days as the production changes from one theatrical scene to another theatrical scene (e.g., from day to night scenes). Each of these scenes often has its own lighting requirements and unique electrical power connectors that may have to be physically changed with other electrical power connectors used at other scenes. However, because the set up time allowed is often of a short duration and because of the varying conditions of compatibility of existing lighting systems from scene to scene, each new set up presents a different and sometimes complex set-up scenario for lighting crews. This situation is further exacerbated by the hard wired nature of the electrical power connectors inside the dimmer boxes. That is, lighting crews are forced to hard wire electrical power connectors to the dimmer boxes that are compatible with the lighting system of the current theatrical scene. This task is time consuming and requires a significant dedication of resources in a situation that is often associated with short time durations in which to accomplish the electrical connector swap out.

As such, there is a need to provide economical and/or efficient methods and systems for increasing a number of lights operated and/or controlled by dimmer boxes of theatrical light systems.

SUMMARY OF THE INVENTION

Aspects of embodiments of the invention are directed to a system and method for increasing a number of lights operated and/or controlled by dimmer boxes of the theatrical light systems.

In an exemplary embodiment of the present invention, a method and system is provided to double the number of lights that can be controlled by a dimmer box, hereafter also referred to as a dimmer, by utilizing one or more doublers having one or more protocol controlled switches. In one embodiment, if a dimmer is capable of controlling 48 light loads (or has 48 controlling channels or is a 48-channel dimmer), then a system according to an embodiment of the present invention is capable of allowing this same dimmer to control 96 light loads. That is, if the dimmer is capable of being connected to eight light connectors (e.g., SOCAPEX cable connectors manufactured by Amphenol-Socapex), and each of the connectors can be used to control six light loads (and have six controlling channels), then the system according to the embodiment of the present invention once connected is capable of allowing the dimmer box to control 16 light connectors (i.e., 96 light loads).

In more detail, an embodiment of the present invention provides a master doubling box and a plurality of slave doubling boxes to double the number of lights that can be controlled by a dimmer box. For example, using the above described 48-channel dimmer box as an example, an embodiment of the present invention includes one master doubling box and seven slave doubling boxes to double the number of light loads controlled by the 48-channel dimmer box from 48 light loads to 96 light loads.

In one embodiment of the present invention, the master doubling box includes a DMX control box connected with one or more control consoles via a DMX cable. As such, the master doubling box can be remotely controlled by the DMX protocols from the one or more control consoles via its DMX control box, which can then control the various slave boxes having their output power cables daisy chained from the master box.

An apparatus for increasing a number of light loads for a dimmer in a theatrical light system according to an exemplary embodiment of the present invention includes a master and at least one slave. The master includes a control signal input for receiving a control signal, a switching signal generator for generating a switching signal corresponding to the control signal, a master demultiplexer, and a master switching signal output. The master demultiplexer selects among a number of master light loads in correspondence to the switching signal, and routes a first light signal to a selected one of the master light loads. The slave includes a slave switching signal input, a slave switching signal output, and a slave demultiplexer. The slave demultiplexer selects among a number of slave light loads in correspondence to the switching signal, and routes a first light signal to a selected one of the slave light loads. The master switching signal output is coupled to the slave switching signal input.

In a further embodiment, a plurality of slaves are utilized, connected in series such that the slave switching signal output of an $(n-1)^{th}$ slave is coupled to the slave switching signal input of the $n^{th}$ slave. For example, the master switching signal output may be only directly coupled to the slave switching signal input of a first slave among the plurality of slaves.

The control signal may be an analog signal or a digital signal, for example, a signal following the industry standard DMX protocol.

A method for increasing a number of light loads of a dimmer in a theatrical light system according to another exemplary embodiment of the present invention includes coupling a master and at least one slave in series. A switching signal is generated corresponding to a control signal. The switching signal is transmitted from the master to the at least one slave. Further, a plurality of light signals are transmitted to each of the master and the least one slave, and one output among a plurality of light signal outputs of each of the master and the at least one slave is selected in correspondence to the switching signal.

A theatrical light system according to yet another exemplary embodiment of the present invention includes a dimmer, a master, and at least one slave. The dimmer includes a first number of light signal outputs for controlling a first number of light loads. The master is for receiving control data from a controller and generating a switching signal corresponding to the control data. The least one slave is for receiving the switching signal from the master. Here, the master and the at least one slave include a second number of light signal outputs for controlling a second number of light loads and are each configured to route a respective light signal from the dimmer in accordance to the switching signal to one among the second number of light signal outputs for controlling the second number of light loads, and the second number is larger than the first number.

The control data may be encoded according to a DMX protocol, and the master may include a switching signal generator for generating the switching signal corresponding to the control data.

A more complete understanding for increasing a number of lights operated and/or controlled by dimmer boxes will be afforded to those skilled in the art, as well as a realization of additional advantages and objects thereof, by a consideration of the following detailed description. Reference will be made to the appended sheets of drawings, which will first be described briefly.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1B:
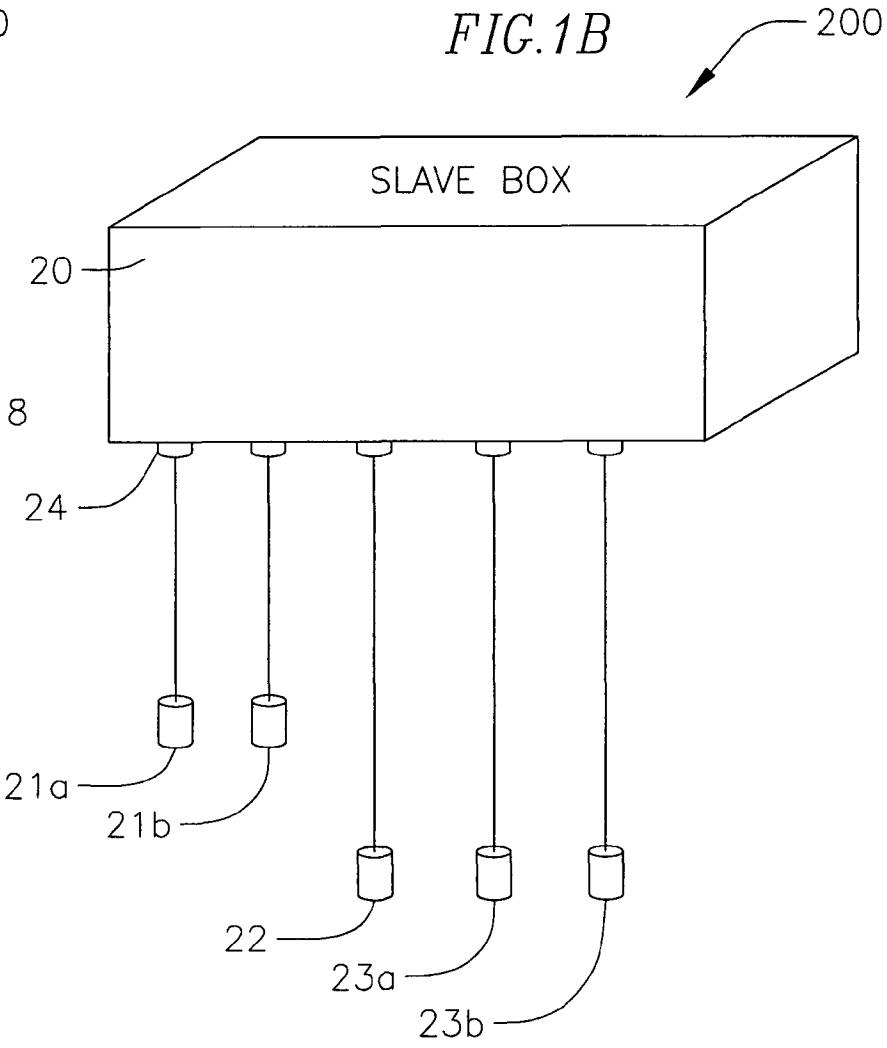
FIGS. 1A and 1B respectively are schematic views of the master doubling boxes and the slave doubling boxes in accordance with an embodiment of the present invention.

In the following detailed description, only certain exemplary embodiments of the present invention will be shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive.

Embodiments of the present invention relate to methods and systems for increasing a number of lights operated and/or controlled by dimmers of theatrical light systems.

In one embodiment, a method and system is provided to double the number of lights that can be controlled by a dimmer by utilizing one or more doubling boxes having one or more protocol controlled switches. As an example, if a dimmer box is capable of controlling 48 light loads (or has 48 controlling channels or is a 48-channel dimmer box), then a system according to an embodiment of the present invention is capable of allowing this same dimmer box to control 96 light loads. That is, if the dimmer box is capable of being connected to six light connectors (e.g., SOCAPEX cable connectors), and each of the connectors can be used to control eight light loads (or can have eight controlling channels), then the system according to the embodiment of the present invention once connected is capable of allowing the dimmer box to control 12 light connectors (i.e., 96 light loads).

In more detail, an embodiment of the present invention provides a master doubling box and a plurality of slave doubling boxes to double the number of lights that can be controlled by a dimmer box. For example, using the above described 48-channel dimmer box as an example, an embodiment of the present invention includes one master doubling box and seven slave doubling boxes to double the number of light loads controlled by the 48-channel dimmer box from 48 light loads to 96 light loads.

In one embodiment of the present invention, the master doubling box includes a DMX control box connected with one or more control consoles via a DMX cable. As such, the master doubling box can be remotely controlled by the DMX protocols from the one or more control consoles via its DMX control box, which can then control the various slave boxes having their output power cables daisy chained from the master box.

Figure 1A:
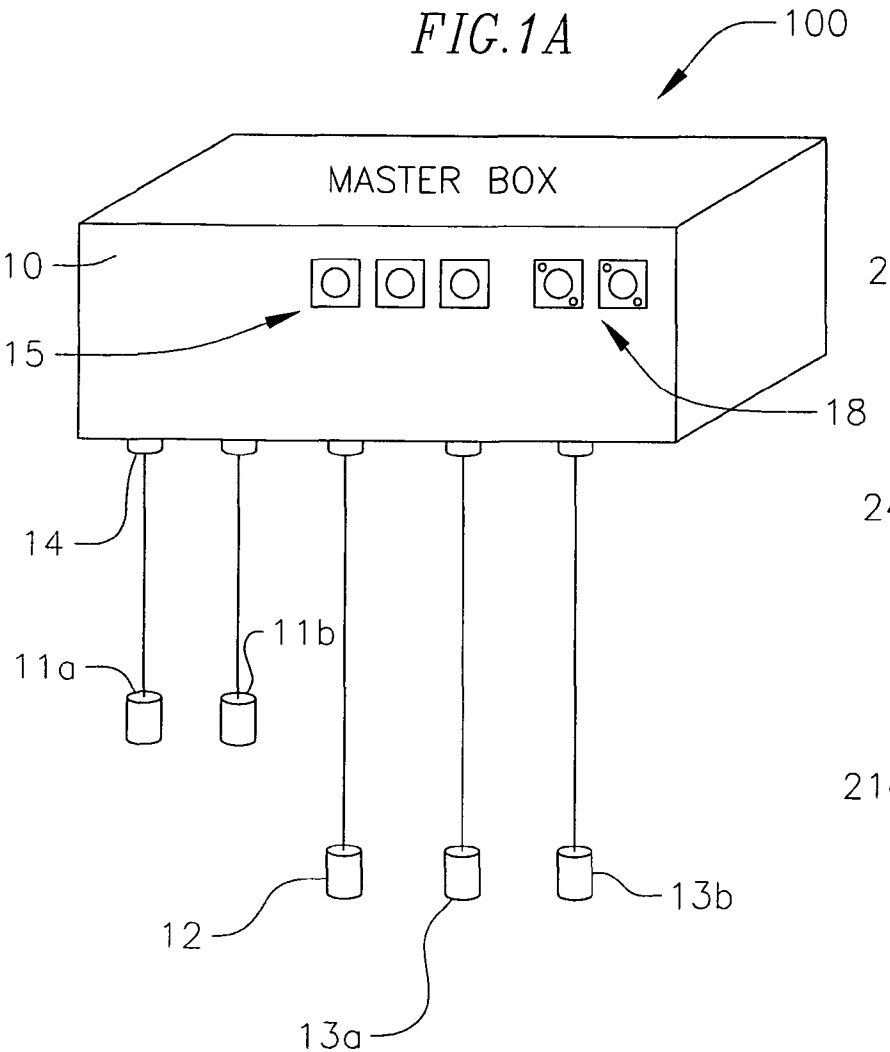

FIGS. 1A and 1B respectively are schematic views of a master doubling box (hereafter also referred to as a master box or master) 100 and a slave doubling box (hereafter also referred to as a slave box or slave) 200 in accordance with an embodiment of the present invention.

As shown in FIG. 1A, the master box 100 includes a first power cord with a male plug 11*a* and a second power cord with a female power plug 11*b* to provide power to the master box 100 and to provide a control line to the slave box 200. In one embodiment, the first power cord with the male plug 11*a* is a 6 to 8 foot power cord composed of 14/3 SJO cable and male U GRD plug, and the second power cord with the female power plug 11*b* is a 6 to 8 foot power cord composed of 14/3 SJO cable and FEMALE U GRD plug. In another embodiment, the first power cord with the male plug 11*a* and the second power cord with the female power plug 11*b* each include a twist-lock plug to make a more reliable and secure connection.

In addition, the master box 100 includes an input cable with a male connector 12 and two output cables with female connectors 13*a* and 13*b*. In one embodiment, the input cable with the male connector 12 is a multi-conductor cable with (14) #12 stranded wires 36 inches in length with a 19 pin male SOCAPEX connector, and the two output cables with the female connectors 13*a* and 13*b* are multi-conductor cables with (14)#12 stranded wires 36 inches in length with 19 pin female SOCAPEX connectors.

Moreover, the master box 100 includes DMX address switches 15 and DMX connectors (XLR DMX connectors) 18 so that the master box 100 can be remotely controlled by DMX protocols from one or more control consoles via the DMX address switches 15 and the DMX connectors 18.

In one embodiment, the master box 100 is formed by a galvanized steel enclosure 10 that is 14 inches long, 7 inches high, and 8 inches deep. The steel enclosure 10 may be connected with the first power cord with the male plug 11*a*, the second power cord with the female power plug 11*b*, the input cable with the male connector 12, the two output cables with the female connectors 13*a* and 13*b* via various suitable strain relief connectors 14. In addition, the first power cord with the male plug 11*a*, the second power cord with the female power plug 11*b*, the input cable with the male connector 12, the two output cables with the female connectors 13*a* and 13*b*, and the steel enclosure 10 may be further connected with each other via various suitable mounting hardware including wire spade lugs, twist-on wire connectors, wire ties, various suitable nuts and bolts, etc.

Referring now to FIG. 1B, the slave box 200 includes a first power cord with a maleplug 21*a* and a second power cord with a female power plug 21*b* to provide power to the slave box 200 and to provide a control line from the master box 100. In one embodiment, the first power cord with the male plug 21*a* is a 6 to 8 foot power cord composed of 14/3 SJO cable and male U GRD plug, and the second power cord with the female power plug 21*b* is a 6 to 8 foot power cord composed of 14/3 SJO cable and female U GRD plug. In another embodiment, the first power cord with the male plug 21*a* and the second power cord with the female power plug 21*b* each include a twist-lock plug to make a more reliable and secure connection.

In addition, the slave box 200 includes an input cable with a male connector 22 and two output cables with female connectors 23*a* and 23*b*. In one embodiment, the input cable with the male connector 22 is a multi-conductor cable with (14) #12 stranded wires 36 inches in length with a 19 pin male SOCAPEX connector, and the two output cables with the female connectors 23*a* and 23*b* are multi-conductor cables with (14)#12 stranded wires 36 inches in length with 19 pin female SOCAPEX connectors.

Here, the slave box 200 does not include DMX address switches and DMX connectors (XLR DMX connectors) but is controlled by DMX protocols through the master box 100 via the first power cord with the male plug 21*a* of the slave box 200 and the second power cord with the female power plug 11*b* of the master box 100.

In one embodiment, the slave box 200 is formed by a galvanized steel enclosure 20 that is 14 inches long, 7 inches high, and 6 inches deep. The steel enclosure 20 may be connected with the first power cord with the male plug 21*a*, the second power cord with the female power plug 21*b*, the input cable with the male connector 22, and the two output cables with the female connectors 23*a* and 23*b* via various suitable strain relief connectors 24. In addition, the first power cord with the male plug 21*a*, the second power cord with the female power plug 21*b*, the input cable with the male connector 22, the two output cables with the female connectors 23*a* and 23*b*, and the steel enclosure 20 may be further connected with each other via various suitable mounting hardware including wire spade lugs, twist-on wire connectors, wire ties, various suitable nuts and bolts, etc.

Figure 1D:
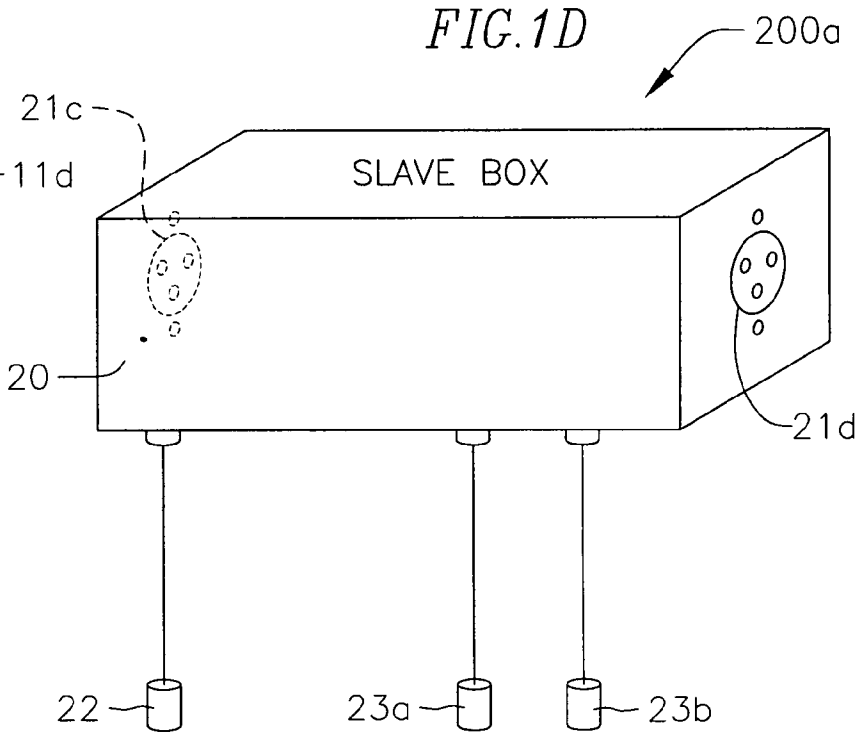
FIGS. 1C and 1D respectively are schematic views of the master doubling boxes and the slave doubling boxes in accordance with another embodiment of the present invention.
Figure 1C:
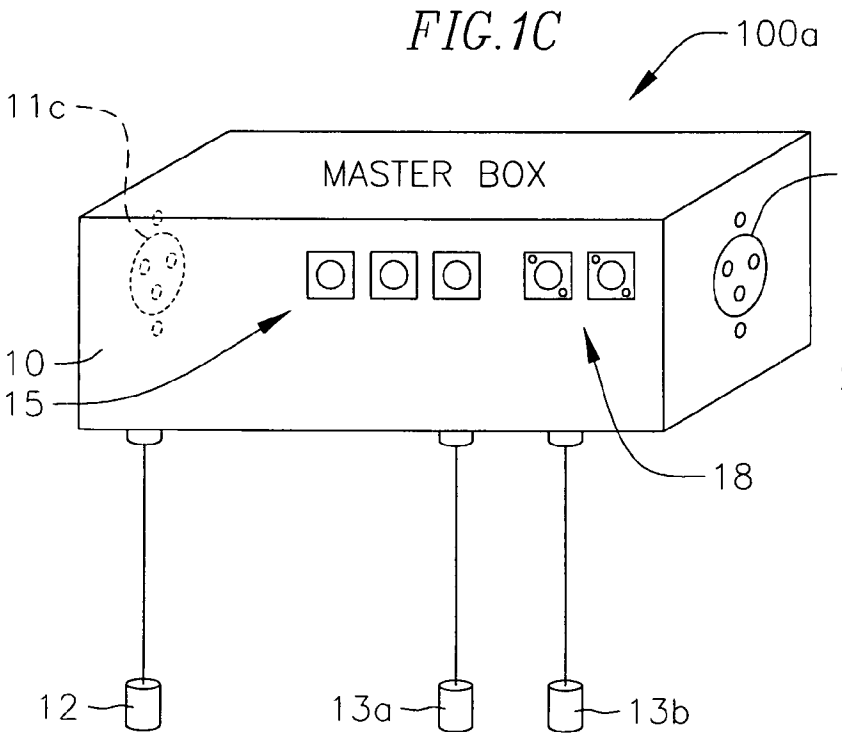

FIGS. 1C and 1D respectively are schematic views of the master doubling boxes and the slave doubling boxes in accordance with another embodiment of the present invention. Some of the differences between the embodiment of FIGS. 1C and 1D and the embodiment of FIGS. 1A and 1B are the overall size of the doubling boxes and the power cords. That is, the doubling boxes of FIGS. 1A and 1B have external 6 to 8 foot power cords with both male and female U GRD (or U Ground) plugs.

By contrast, the doubling boxes 100*a* and 200*a* of FIGS. 1C and 1D have both the male and female U GRD (or U Ground) plugs 11*c*, 11*d*, 21*c*, and 21*d* mounted directly to the boxes. In one embodiment, extension cables for connecting the plug 11*d* to one plug 21*c*, and connecting the plugs 21*d* to other plugs 21*c* to couple the master 100*a* and the slaves 200*a* in series are composed of 14/3 SJO cable provided with both male and female U GRD (or U Ground) connectors. In other embodiments, twist-lock connectors, or any other suitable connector may be used. These extension cables are used to power the master doubling box 100*a* of FIG. 1C and the slave doubling box 200*a* of FIG. 1D.

Figure 2:
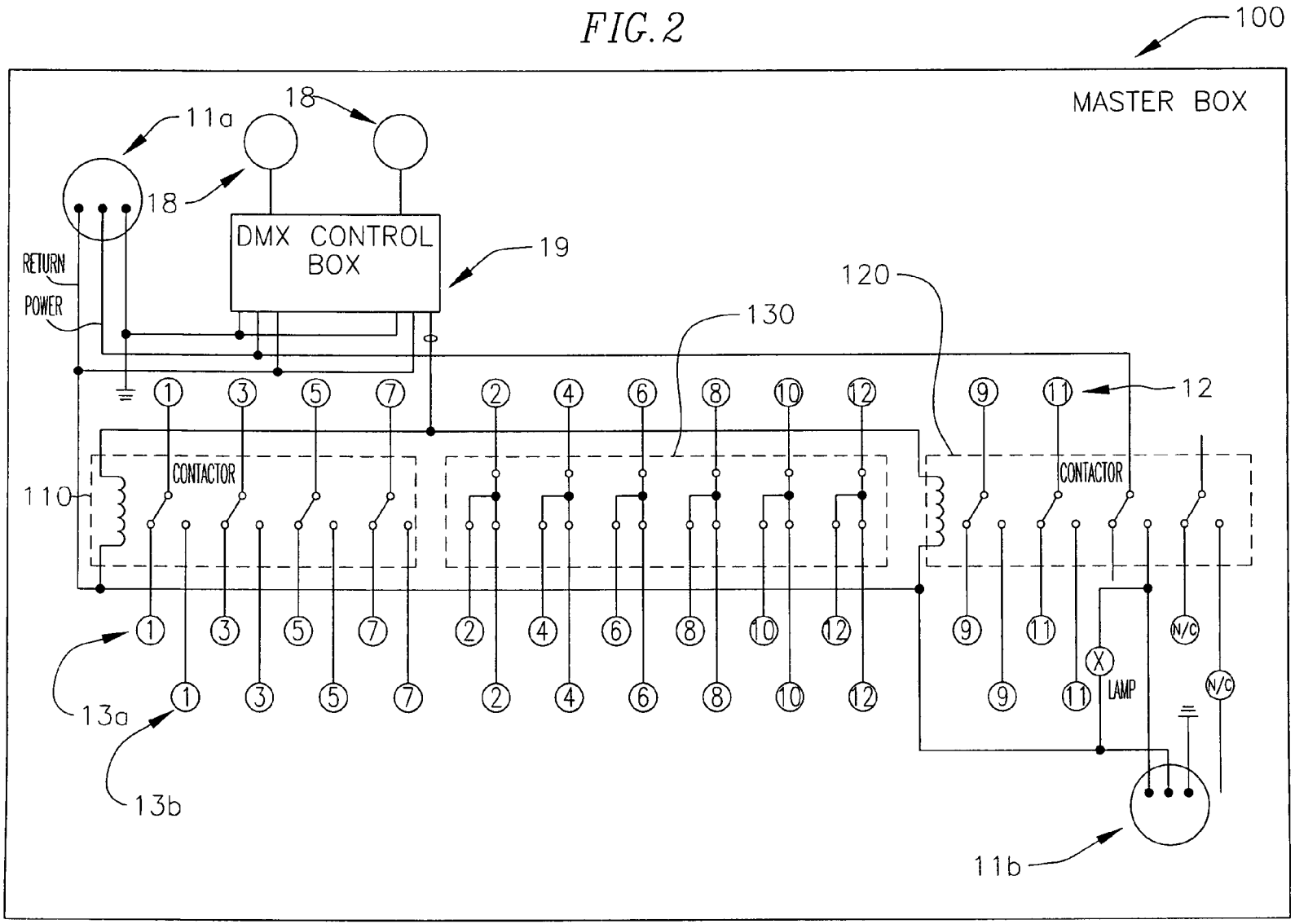
FIG. 2 is a wiring schematic of a master doubling box according to an embodiment of the present invention.

FIG. 2 is a wiring schematic of the master box 100 according to an embodiment of the present invention. In FIG. 2, the master box 100 includes a DMX control box 19 connected to one or more control consoles via a DMX cable. Here, the DMX cable is connected to the DMX connectors 18 as described above. In one embodiment as shown in FIG. 2, the DMX connectors 18 are 5 pin XLR control connectors.

The master box 100 shown in FIG. 2 also includes a first contactor 110 and a second contactor 120 that are controlled by the DMX control box 19 to selectively switch to be in either an output A state or an output B state. Here, in the output A state, the input cable with the male connector 12 is connected to the output cable with the female connector 13*a* so that signals (or powers) from the input cable with the male connector 12 is applied to the output cable with the female connector 13*a*. By contrast, in the output B state, the input cable with the male connector 12 is connected to the output cable with the female connector 13*b* so that signals (or powers) from the input cable with the male connector 12 is applied to the output cable with the female connector 13*b*.

In more detail, the contactors 110 and 120 include coils and contacts controlled by the DMX control box 19 to selectively switch to be in either the output A state or the output B state. In one embodiment, the contactors 110 and 120 are contactors with 120 VAC coils and 35 AMP contacts and/or are four poles, double throw and electrically held contactors. In another embodiment, the contactors 110 and 120 are actuated by DC. One skilled in the art would comprehend that various other switching devices may be used still falling within the scope of the invention including relays, solid state switches, etc.

The master box 100 also includes a neutral strip 130 to complete the circuit. In one embodiment, the neutral strip 130 is a 6 position #10 wire terminal strip used for neutral connectors.

Here, according to one embodiment, the neutral strip 130 and the contactors 110 and 120 are mounted to a contactor and neutral terminal sub mounting assembly board that is located within the master box 100.

Also, as shown in FIG. 2, in one embodiment, each of the male and female connectors 12, 13*a* and 13*b* is a 19 pin SOCAPEX connector. In such connectors, pins 13-19 are grounding pins (grounds) for the connectors, pins 1, 3, 5, 7, 9, and 11 are hot (power) pins for the connectors, and pins 2, 4, 6, 8, 10, and 12 are neutral pins for the connectors.

As such, in operation, using the above described 48-channel dimmer box as an example, once the master box 100 of FIG. 2 is connected to one of the six light connectors of the dimmer box, this one light connector of the dimmer box is capable of controlling 12 light loads instead of just six light loads. That is, the master box 100 allows this one light connector of the dimmer box to selectively switch to be either connected to a first set of six light loads connected to the output cable with the female connector 13*a* in the output A state or a second set of six light loads connected to the output cable with the female connector 13*b* in the output B state. Here, the first set of the six light loads are powered (or turned on) when the input cable with the male connector 12 is connected to the output cable with the female connector 13*a* so that signals (or powers) from the input cable with the male connector 12 are applied to the output cable with the female connector 13*a* that is connected to the first set of the six light loads. Alternatively, the second set of the six light loads are powered (or turned on) when the input cable with the male connector 12 is connected to the output cable with the female connector 13*b* so that signals (or powers) from the input cable with the male connector 12 are applied to the output cable with the female connector 13*b* that is connected to the second set of the six light loads.

Figure 3:
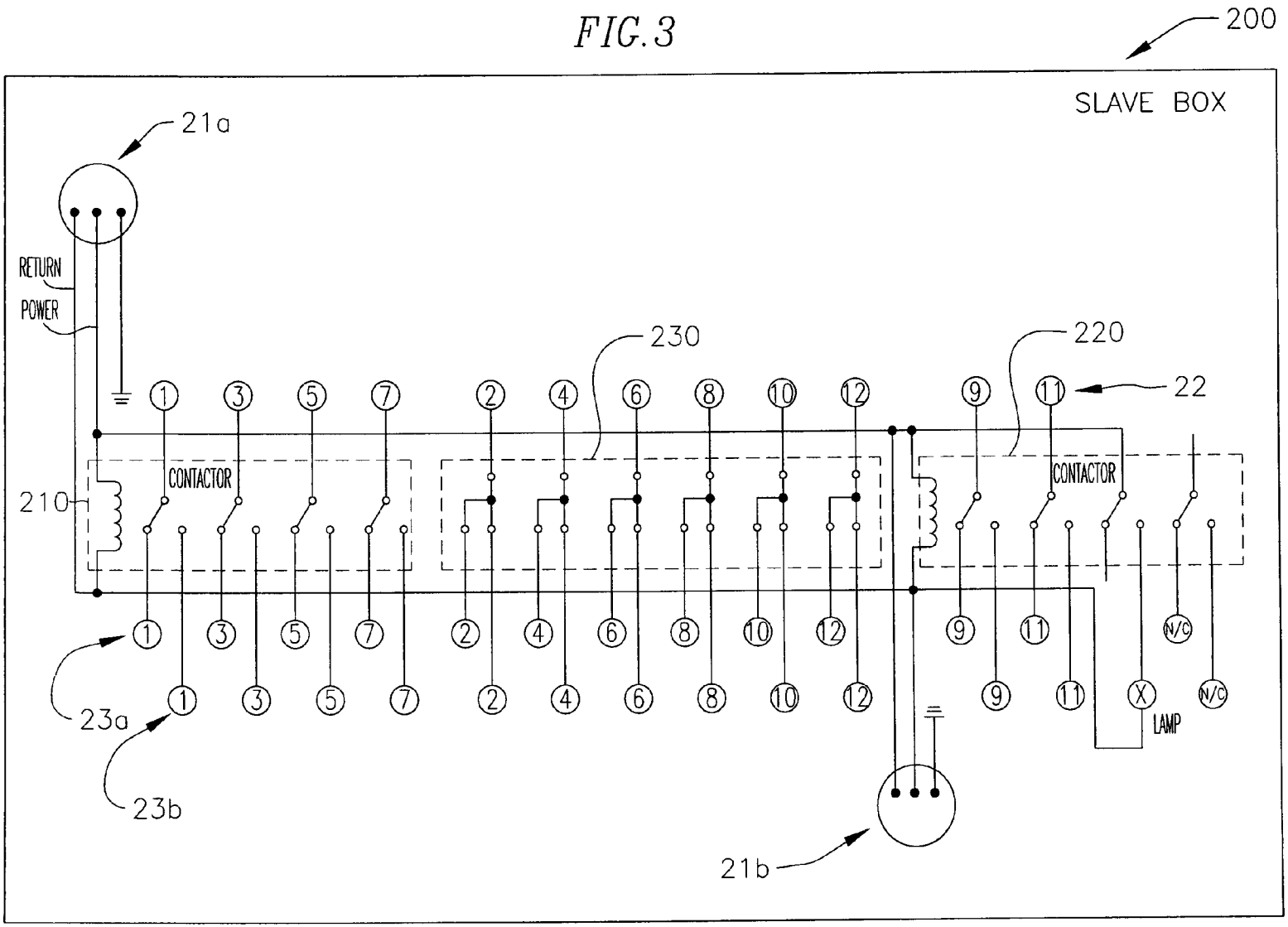
FIG. 3 is a wiring schematic of a slave doubling box according to an embodiment of the present invention.

FIG. 3 is a wiring schematic of the slave box 200 according to an embodiment of the present invention. In FIG. 3, the slave box 200 does not include a DMX control box, but does include a first contactor 210 and a second contactor 220 that are controlled by the DMX control box 19 in the master box 100 to selectively switch to be in either an output A state or an output B state. That is, the slave box 200 is controlled by the DMX control box 19 through its connection with the master box 100. Here, in the output A state, the input cable with the male connector 22 is connected to the output cable with the female connector 23*a* so that signals (or powers) from the input cable with the male connector 22 is applied to the output cable with the female connector 23*a*. By contrast, in the output B state, the input cable with the male connector 22 is connected to the output cable with the female connector 23*b* so that signals (or powers) from the input cable with the male connector 22 is applied to the output cable with the female connector 23*b*.

In more detail, the contactors 210 and 220 include coils and contacts controlled by the DMX control box 19 of the master box 100 to selectively switch to be in either the output A state or the output B state. In one embodiment, the contactors 210 and 220 are contactors with 120 VAC coils and 35 AMP contacts and/or are four poles, double throw and electrically held contactors.

The slave box 200 also includes a neutral strip 230 to complete the circuit. In one embodiment, the neutral strip 230 is a 6 position #10 wire terminal strip used for neutral connectors.

Here, according to one embodiment, the neutral strip 230 and the contactors 210 and 220 are mounted to a contactor and neutral terminal sub mounting assembly board that is located within the slave box 200.

Also, as shown in FIG. 3, in one embodiment, each of the male and female connectors 22, 23*a* and 23*b* is a 19 pin SOCAPEX connector. In such connectors, pins 13-19 are grounding pins (grounds) for the connectors, pins 1, 3, 5, 7, 9, and 11 are hot (power) pins for the connectors, and pins 2, 4, 6, 8, 10, and 12 are neutral pins for the connectors.

As such, in operation, using the above described 48-channel dimmer box as an example, once the master box 100 of FIG. 2 and the slave box 200 of FIG. 3 are connected to two of the eight light connectors of the dimmer box, these two light connectors of the dimmer box are capable of controlling 24 light loads instead of just 12 light loads. That is, the master box 100 and the slave box 200 allow these two light connectors of the dimmer box to selectively switch to be either connected to a first set of 12 light loads connected to the output cables with the female connectors 13*a* and 23*a* in the output A state or a second set of 12 light loads connected to the output cables with the female connectors 13*b* and 23*b* in the output B state. Here, the first set of the 12 light loads are powered (or turned on) when the input cables with the male connectors 12 and 22 are connected to the output cables with the female connectors 13*a* and 23*a* so that signals (or powers) from the input cables with the male connectors 12 and 22 are applied to the output cables with the female connectors 13*a* and 23*a* that are connected to the first set of the 12 light loads. Alternatively, the second set of the 12 light loads are powered (or turned on) when the input cables with the male connectors 12 and 22 are connected to the output cables with the female connectors 13*b* and 23*b* so that signals (or powers) from the input cables with the male connectors 12 and 22 are applied to the output cables with the female connectors 13*b* and 23*b* that are connected to the second set of the 18 light loads.

Figure 4A:
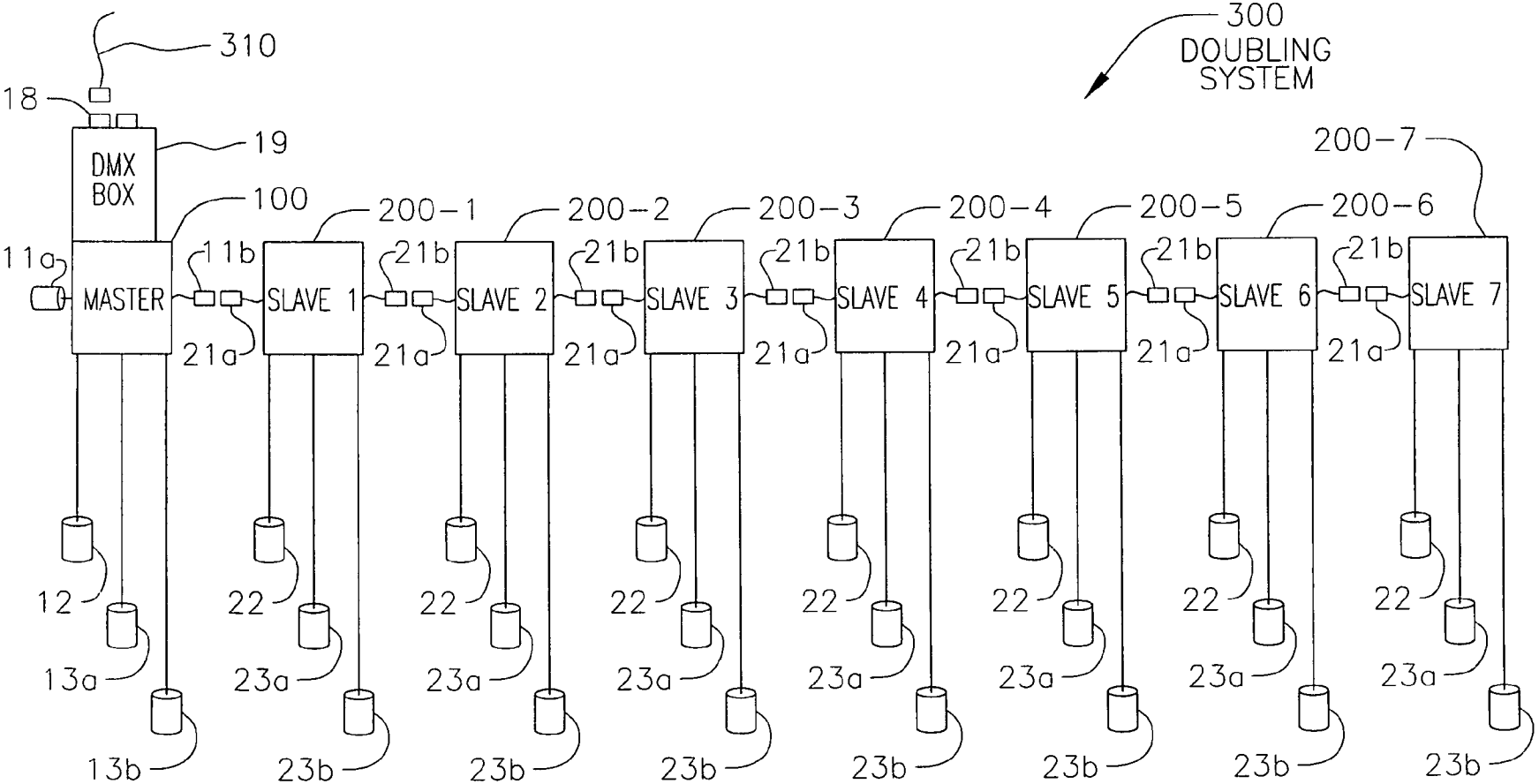
FIG. 4A is a wiring schematic of a doubling system for allowing a 48-channel dimmer box to operate and/or control 96 light loads according to an embodiment of the present invention.

FIG. 4A is a wiring schematic of a doubling system 300 for allowing a 48-channel dimmer box to operate and/or control 96 light loads according to an embodiment of the present invention.

Referring to FIG. 4A, the doubling system 300 of the present invention provides a master doubling box (e.g., the master box 100) and a plurality of slave doubling boxes (e.g., the slave box 200) to double the number of lights that can be controlled by a dimmer box. For example, using the above described 48-channel dimmer box as an example, an embodiment of the present invention includes one master doubling box 100 and seven slave doubling boxes 200-1 to 200-7 to double the number of light loads controlled by the 48-channel dimmer box from 48 light loads to 96 light loads.

Also, in one embodiment of the present invention, the master doubling (or Zen™) box includes a DMX control box (e.g., the DMX control box 19) connected to one or more control consoles via a DMX cable 310. As such, the master doubling box 100 can be remotely controlled by the DMX protocols from the one or more control consoles via its DMX control box, which can then control the various slave boxes 200-1 to 200-7 having their output power cables 320 daisy chained from the master box (i.e., serially connected from the master to the slaves 1 through 7).

Figure 4B:
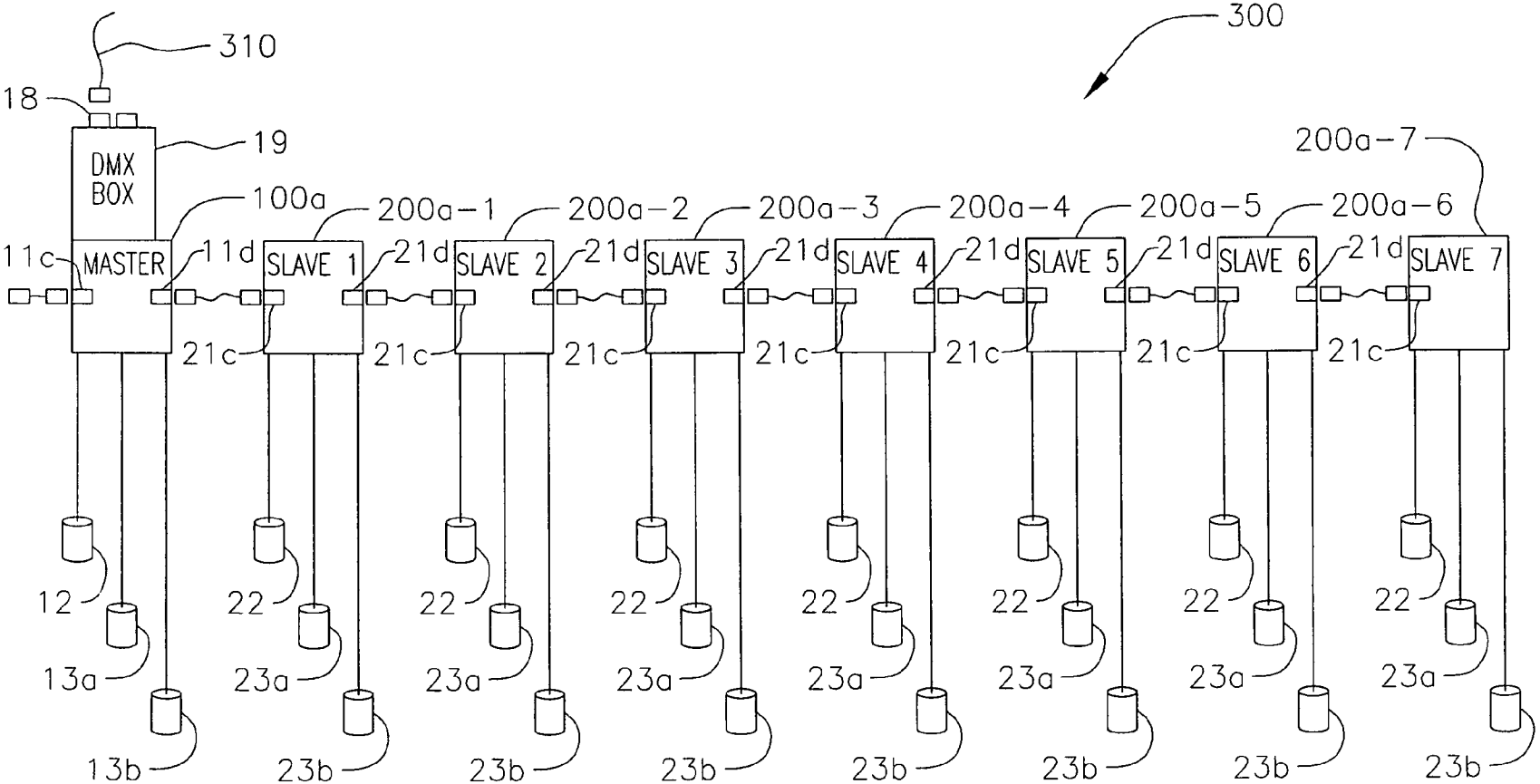
FIG. 4B is a wiring schematic of a doubling system for allowing a 48-channel dimmer box to operate and/or control 96 light loads according to another embodiment of the present invention.

FIG. 4B is a wiring schematic of a doubling system for allowing a 48-channel dimmer box to operate and/or control 96 light loads according to another embodiment of the present invention.

Figure 5:
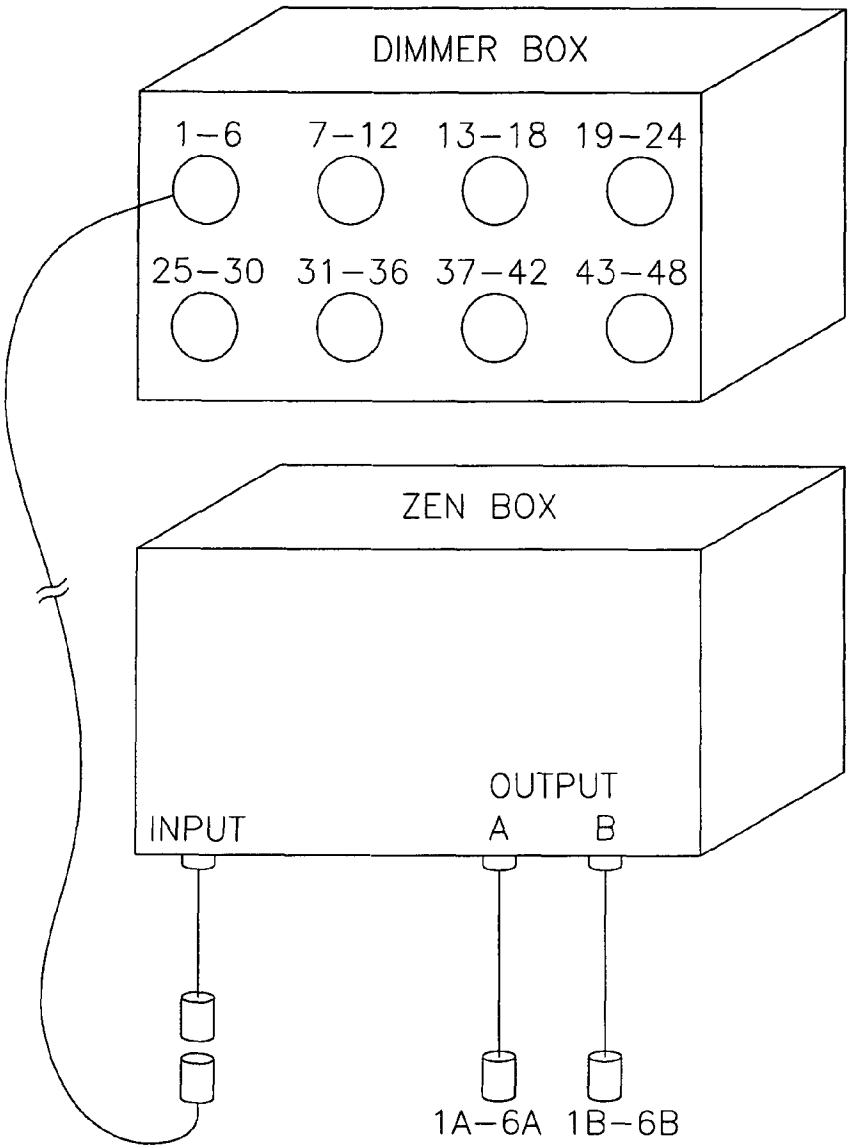
FIG. 5 is a schematic of a system including a dimmer box and a doubling (or Zen™) box in accordance with an embodiment of the present invention.

FIG. 5 is a schematic of a system including a dimmer box and a doubling box in accordance with an embodiment of the present invention.

In view of the foregoing, a method and system is provided to double the number of lights that can be controlled by a dimmer box. As an example, if a dimmer box is capable of controlling 48 light loads (or has 48 controlling channels or is a 48-channel dimmer box), then a system according to an embodiment of the present invention is capable of allowing this same dimmer box to control 96 light loads. That is, if the dimmer box is capable of being connected to eight light connectors (e.g., SOCAPEX cable connectors) and each of the connectors can be used to control six light loads (or controlling channels), then the system according to the embodiment of the present invention once connected is capable of allowing the dimmer box to control 16 light connectors (i.e., 96 light loads).

While certain exemplary embodiments have been described in detail and shown in the accompanying drawings, it is to be understood that such embodiments are merely illustrative of and not restrictive of the broad invention. It will thus be recognized by a person skilled in the art that various modifications may be made to the illustrated and other embodiments of the invention described above, without departing from the broad inventive scope thereof. In view of the above it will be understood that the invention is not limited to the particular embodiments or arrangements disclosed, but is rather intended to cover any changes, adaptations or modifications which are within the scope and spirit of the invention as defined by the appended claims and equivalents thereof.

What is claimed is:

1. An apparatus for increasing a number of light loads of a dimmer in a theatrical light system, comprising:

a master comprising:

a control signal input for receiving a control signal;

a switching signal generator for generating a switching signal corresponding to the control signal;

a master demultiplexer for selecting among a number of master light loads in correspondence to the switching signal, and for routing a first light signal to a selected one of the master light loads; and a master switching signal output for transmitting the switching signal; and at least one slave comprising:

a slave switching signal input for receiving the switching signal;

a slave demultiplexer for selecting among a number of slave light loads in correspondence to the switching signal, and for routing a second light signal to a selected one of the slave light loads; and a slave switching signal output for transmitting the switching signal, wherein the master switching signal output is coupled to the slave switching signal input of the at least one slave.

2. The apparatus of claim 1, wherein the at least one slave comprises a plurality of slaves connected in series such that the slave switching signal output of an $(n-1)^{th}$ slave is coupled to the slave switching signal input of an $n^{th}$ slave.

3. The apparatus of claim 2, wherein the master switching signal output is only directly coupled to the slave switching signal input of a first slave among the plurality of slaves.

4. The apparatus of claim 2, wherein the control signal comprises a DMX protocol signal.

5. The apparatus of claim 2, wherein each of the master and the plurality of slaves is configured to double the number of light loads of a corresponding dimmer channel of the dimmer.

6. The apparatus of claim 2, further comprising a plurality of cables for coupling the master and the slaves in series, the cables comprising a ground line, a switching signal line, and a return line.

7. The apparatus of claim 6, wherein a first cable of the plurality of cables is coupled between the master switching signal output and the slave switching signal input of a first slave, and each of the remaining cables is coupled between a corresponding one of the slave switching signal outputs and a corresponding one of the slave switching signal inputs.

8. A method for increasing a number of light loads of a dimmer in a theatrical light system, the method comprising:

coupling a master and at least one slave in series;

generating a switching signal corresponding to a control signal;

transmitting the switching signal from the master to the at least one slave;

transmitting a plurality of light signals to each of the master and the at least one slave; and selecting one output among a plurality of light signal outputs of each of the master and the at least one slave, in correspondence to the switching signal.

9. The method of claim 8, wherein the at least one slave comprises a plurality of slaves, wherein the coupling the master to the at least one slave in series comprises directly coupling the master to a first slave among the plurality of slaves, and coupling remaining slaves to one another in series.

10. A theatrical light system, comprising:

a dimmer comprising a first number of light signal outputs for controlling a first number of light loads;

a master for receiving control data from a controller and generating a switching signal corresponding to the control data; and at least one slave for receiving the switching signal from the master, wherein the master and the at least one slave comprise a second number of light signal outputs for controlling a second number of light loads and are each configured to route a respective light signal from the dimmer in accordance to the switching signal to one among the second number of light signal outputs for controlling the second number of light loads, and wherein the second number is larger than the first number.

11. The system of claim 10, wherein the control data is encoded according to a DMX protocol, and the master further comprises a switching signal generator for generating the switching signal corresponding to the control data.

12. The system of claim 10, wherein the at least one slave comprises a plurality of slaves connected in series and connected with the master only through a first slave among the plurality of the slaves to receive the switching signal.

* * * * *